US009500026B2

(12) United States Patent
Mountain

(10) Patent No.: US 9,500,026 B2
(45) Date of Patent: Nov. 22, 2016

(54) FOLDING AND SELF-ERECTING LADDER

(71) Applicant: Mattingly & Malur PC, Alexandria, VA (US)

(72) Inventor: Maurice J. Mountain, Alexandria, VA (US)

( * ) Notice: Subject to any disclaimer, the term of this patent is extended or adjusted under 35 U.S.C. 154(b) by 209 days.

(21) Appl. No.: 14/301,694

(22) Filed: Jun. 11, 2014

(65) Prior Publication Data

US 2015/0114754 A1 Apr. 30, 2015

Related U.S. Application Data

(60) Provisional application No. 61/962,052, filed on Oct. 30, 2013.

(51) Int. Cl.

| | |
|---|---|
| ***E06C 1/383*** | (2006.01) |
| ***B63B 27/14*** | (2006.01) |
| ***E06C 1/56*** | (2006.01) |
| ***E06C 1/58*** | (2006.01) |
| ***E06C 7/48*** | (2006.01) |
| *E06C 1/36* | (2006.01) |

(52) U.S. Cl.

CPC ..... *E06C 1/383* (2013.01); *B63B 27/146* (2013.01); *E06C 1/56* (2013.01); *E06C 1/58* (2013.01); *E06C 7/48* (2013.01); *E06C 1/36* (2013.01)

(58) Field of Classification Search

CPC ..... E06C 1/383; E06C 1/56; E06C 1/58; E06C 7/48; B63B 27/146

See application file for complete search history.

(56) References Cited

U.S. PATENT DOCUMENTS

| | | | | | |
|---|---|---|---|---|---|
| 162,398 | A * | 4/1875 | Matteson | E06C 1/56 | 182/197 |
| 194,082 | A * | 8/1877 | Falk | E06C 1/56 | 182/164 |
| 581,348 | A * | 4/1897 | Hunt | E06C 1/383 | 182/159 |
| D185,212 | S * | 5/1959 | Klages | | 182/206 |
| 2,924,291 | A | 2/1960 | Tunstead | | |
| 2,992,697 | A | 7/1961 | Klages | | |
| 3,512,608 | A | 5/1970 | Huntley | | |
| 4,463,829 | A * | 8/1984 | Grin | E06C 1/383 | 182/108 |
| 4,815,564 | A * | 3/1989 | Yoo | E06C 1/32 | 182/160 |
| 4,998,982 | A * | 3/1991 | Arnold | E06C 1/12 | 182/107 |
| 5,113,782 | A | 5/1992 | McCarty | | |
| 5,329,873 | A | 7/1994 | Tiballi | | |
| 6,145,621 | A | 11/2000 | Nye | | |
| 2013/0037350 | A1 * | 2/2013 | Geiselman, III | E06C 1/383 | 182/108 |

FOREIGN PATENT DOCUMENTS

| | | | | |
|---|---|---|---|---|
| FR | 2825972 A1 * | 12/2002 | ..... | B63B 27/14 |

* cited by examiner

*Primary Examiner* — Colleen M Chavchavadze

(74) *Attorney, Agent, or Firm* — Mattingly & Malur, PC

(57) ABSTRACT

A folding, self-erecting ladder for use in the marine environment comprises two rigid side rails with holes for holding rungs. Bungee cord is thread through the rungs and rails to tension the rails toward each other top hold the rungs in the rail holes. The ladder can be folded by pulling the rails apart, allowing the rungs to leave the rail holes, and moving the rails closer to each other, trapping the rungs therebetween, and binding the folded ladder to hold it in the folded position.

19 Claims, 8 Drawing Sheets

FOLDING AND SELF-ERECTING LADDER

BACKGROUND OF THE INVENTION

People in small boats end up in the water for a variety of reasons. Rowers in inherently unstable crew shells often work out in unfavorable conditions of cold weather and rough water made worse by wind and should get out of the water as quickly as possible when the boat swamps or turns over. Any boat presents difficulties when a swimmer tries to lift him or herself over the gunnels (gunwales) and back into the boat or into a rescue boat.

A number of so-called folding ladders have been designed to aid in this difficulty but a majority of them are non-rigid rope ladders that are tossed over the side and all have the inherent problem of becoming unstable and difficult to climb because they tend to be forced under the bottom of the boat as the swimmer puts weight on the bottom rung. Such a folding ladder can be seen at:

(http://www.mysticmarinediscounts.com/sea-dog-corp-folding-ladder-5825011-ladder-five-step-rope.html)

A similar ladder is shown in FIG. 8 with rungs 100, rails 200, and rope 300 threaded through the rungs and rails. When held by the rope ends 400 designed to attach the ladder to a boat, gravity will drop the rails and rungs to straighten the rope, forming a ladder with parallel rails 500 and parallel rungs perpendicular to the rails. Rope ladders have no "stand-off" feature and most of the straight rigid ladders that hook over the side rail of the hull do not have any such feature. Without this "stand-off," the swimmers fingers and toes on the rungs of most such ladders are therefore jammed up against the hull, making it difficult or less secure to get a safe grip while attempting to climb into the boat.

Similarly, there are many folding ladders on the market that have mechanical hinges that have to be opened as the ladder is deployed. See U.S. Pat. No. 6,145,621 to Nye. Not only are these mechanical parts potentially subject to jamming (making them difficult and time-consuming to open), but alternatively they may become loosened and unstable once they are opened and such movement could eventually compromise the safety and reliability of the ladder.

Likewise, almost all of the boat ladders on the market have to have some external means of attaching them to the boat—such as a bracket screwed permanently into the hull at a particular location into which the ladder is fitted during use, or to which the ladder itself is permanently attached in its folded position when not deployed for rescuing an overboard swimmer. This prohibits the ladder from being deployed at the position on the boat where it is needed. If the water is cold, the swimmer should get into the boat quickly to avoid hypothermia. Indeed, even the simple rope ladders have to be tied onto a rail or some other structure on the boat, which only adds additional time and uncertainty during an emergency rescue.

As for those rigid ladders which do have some sort of stand-off feature, the stand-off feature usually consists of some short legs extending horizontally from the side rails to hold the ladder away from the side of the hull. See U.S. Pat. No. 5,113,782 (McCarty), U.S. Pat. No. 2,924,291 (Tunstead), Des. 185,212 and U.S. Pat. No. 2,992,697 (Klages), and U.S. Pat. No. 3,512,608 (Huntley). These short legs sometimes fold out from the rails. This mechanical feature adds to the complexity of the device, potentially increases the time for deployment, and may in fact prove to be totally useless if it is at the bottom of the ladder and below the bottom of the hull on a shallow-draft boat like a jonboat (usually termed a "launch") used by a crew coach to follow the shell during practice sessions, etc. These launches or chase boats are required to carry a safety equipment bag including life vests. If a quickly deployable ladder were available to fit in the safety equipment bag carried by chase boats, the rowers' safety would be enhanced in a simple and effective way.

SUMMARY OF THE INVENTION

There is a need for a small, rigid-when-deployed, quickly deployable ladder capable of easy attachment to the gunnels of a watercraft in an emergency situation to allow a swimmer to lift him or herself out of the water into the craft as quickly as possible. Instant deployment is important for obvious safety reasons. U.S. Pat. No. 5,329,873 to Tiballi recognizes the need for quick deployment of a safety dive flag from a folded position. The flag is folded in a small, convenient bundle in FIG. 5 of Tiballi and is quickly erected using tube sections joined by elastic cord 30 of FIG. 4 in Tiballi.

The ladder of the invention has rigid side rails and will maintain its vertical (or even slightly inclined away from the boat) position against the boat hull as the swimmer climbs up the rungs, which provides a far more secure and safe operation than the instability of a swinging rope ladder.

The ladder of the invention has no mechanical hinges connecting the rungs to the rails. Rather, the rungs automatically insert into the rails when opened to form a secure and fool-proof connection that is not subject to movement during use. Bungee cord (shock cord) is threaded through the rails and rungs and held under tension when the ladder is folded. The assembly remains under tension when the folded ladder is released to allow the rungs to be positioned between the rails and nest in the rails to form a rigid ladder.

The ladder of the invention snaps open instantly from its folded storage state and can immediately be hung over the gunnels of a water craft when needed, and can be positioned at any position on the boat gunnels to be deployed closest to the swimmer in need of help. The hooks at the top of the rails of the inventive ladder are intended to be compatible with the gunnels of a standard jonboat, but will also work on a canoe. These hooks can easily be modified to present a more universal geometry to fit any boat rail or gunnel. A second set of different shaped hooks on the bottom end of the ladder rails can be provided so that the device could be deployed on boats with various shaped gunnels or transoms simply by turning it upside down and hanging it using whichever set of hooks best fit a particular gunnel.

The inventive ladder has a built in "stand-off", projection, or protrusion to engage the hull on each rail that keeps it hanging at least vertically or slightly inclined away from the hull during deployment, making it far easier for a swimmer to climb up the rungs. The ladder of this invention is designed with a bulge at the top of the device just below the hooks that serves to hold the rails away from the side of the boat so that the swimmer's fingers and toes have room to securely grab onto the rungs without hitting the hull. Moreover, since this stand-off bulge is at the top of the ladder, it will properly function even on very shallow-draft hulls, unlike the stand-off legs that are at the bottom of many rigid ladders. Finally, that the design of the bulge is intended to press the rails against the hull when the swimmer's weight is on the ladder, which makes sure the hooks stay fully engaged on the gunnel and the ladder remains firmly in place as the swimmer ascends into the boat.

The inventive ladder is constructed to float if it is accidentally dropped overboard, which most likely is not true with the prior art rigid mechanical ladders, most of which are made of aluminum or stainless steel. The present design using plywood rails floats naturally.

These and other features and advantages will be evident from the drawings and detailed description below.

DETAILED DESCRIPTION

Figure 1:
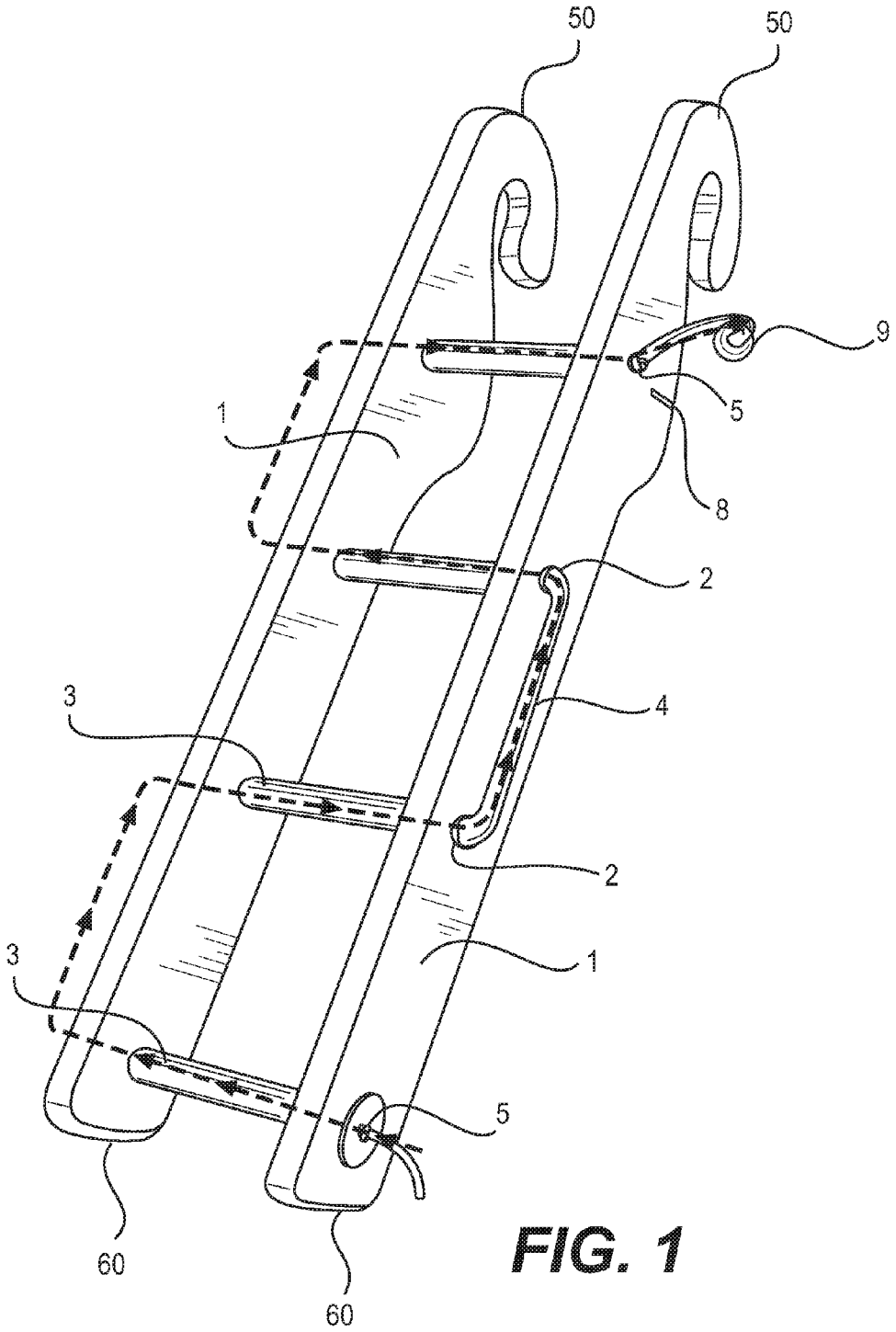
FIG. 1 is a plan view of the inventive ladder in the erected state.
Figure 2:
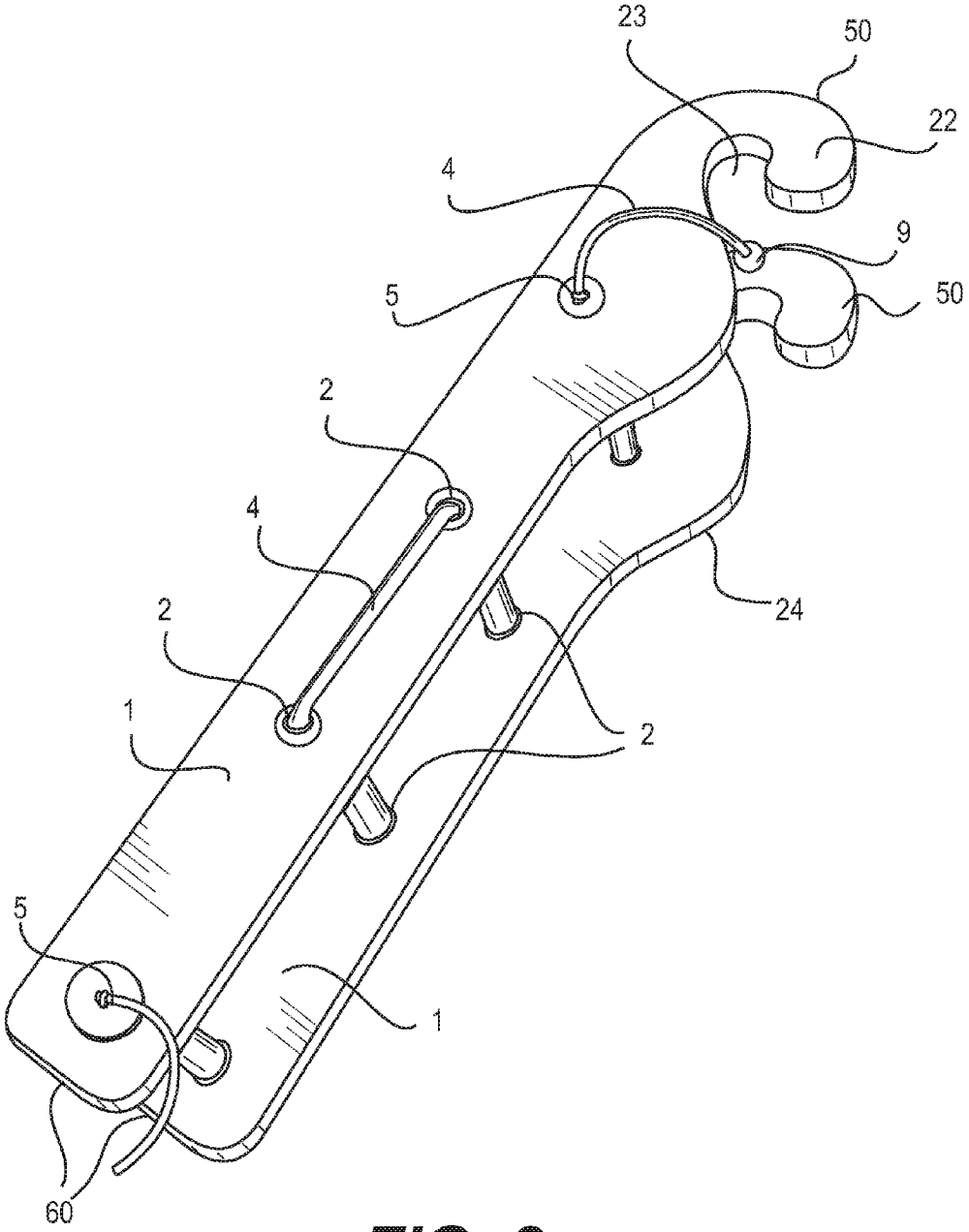
FIG. 2 is a side view of the erected ladder.

FIGS. 1 and 2 show the folding ladder of the invention. Single piece rails 1 comprise a top end 50, a bottom end 60, a series of holes 2 into which rungs 3 fit snuggly to form the ladder. The rungs 3 and holes 2 are tapered to mate snuggly to form a rigid connection when tensioned together by bungee cord 4. The bungee cord is held in tension by appropriate knots 5. Any means can be employed to prevent the knot 5 from passing through hole 4. The tension of the bungee is sufficient to bring the rungs and rails into alignment to mate the rungs 3 with the holes 2, forming a rigid ladder when the ladder is released from its folded orientation, described below.

Figure 3:
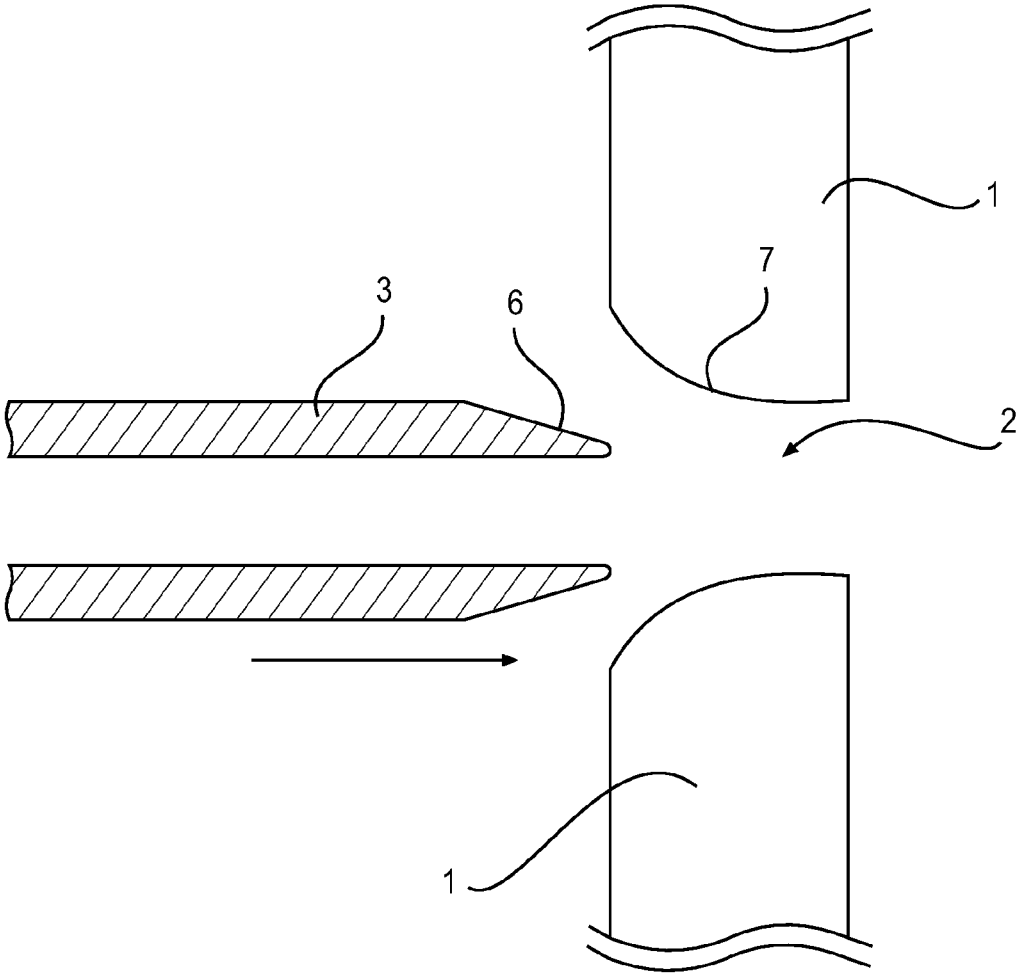
FIG. 3 is a vertical section through a rail hole showing the relationship of the hole, the rung and the elastic cord.

FIG. 3 shows the rungs 3 and hole 2. The rung 3 in the figure has tapered ends 6 (only one end shown) pulled into tapered hole 7 of rail 1 by the tension of bungee cord 2 (in the direction of the arrow in FIG. 3) but the holes and rungs preferably have straight walls. A straight walled rung end 3 will properly seat in a straight walled hole. The rung entry end of hole 2 will have a larger diameter than the bungee cord exit end of the hole. When the hole is straight walled, a shoulder between the larger and small diameters will stop the rung at an intermediate position in the hole to seat it securely, held by the tension of bungee cord 4.

The ladder is assembled by threading a bungee cord 4 through one of the top or bottom-most rail holes 2 with a knot 5 on the end of the cord. Cord 4 is then passed through a rung 3 and through the opposite rail, passed up to the next hole on the same rail, through a rung and so on until the cord 4 exits the last unfilled hole 2, following the dotted line with arrows of FIG. 1). The cord 4 is tensioned and a second knot is tied to keep the cord from passing through the last hole. The tension is sufficient to hold the ladder in its "use" configuration but loose enough to allow folding of the ladder as described below. Sufficient cord if left beyond the knot 5 at the top of the ladder to hold the ladder in the folded orientation of FIG. 4. An additional knot or other enlargement 9 is placed on the end of cord 4 to maintain the cord in slot 8 when the ladder is folded.

Figure 4:
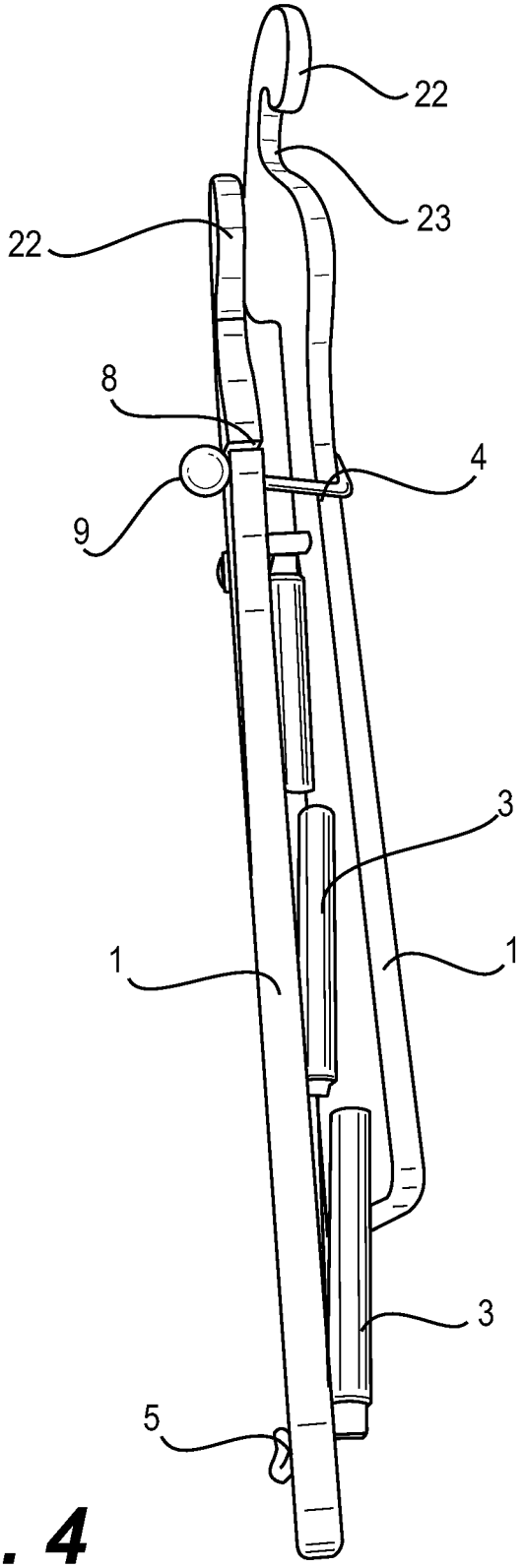
FIG. 4 is a plan view of the ladder in the folded state.
Figure 5:
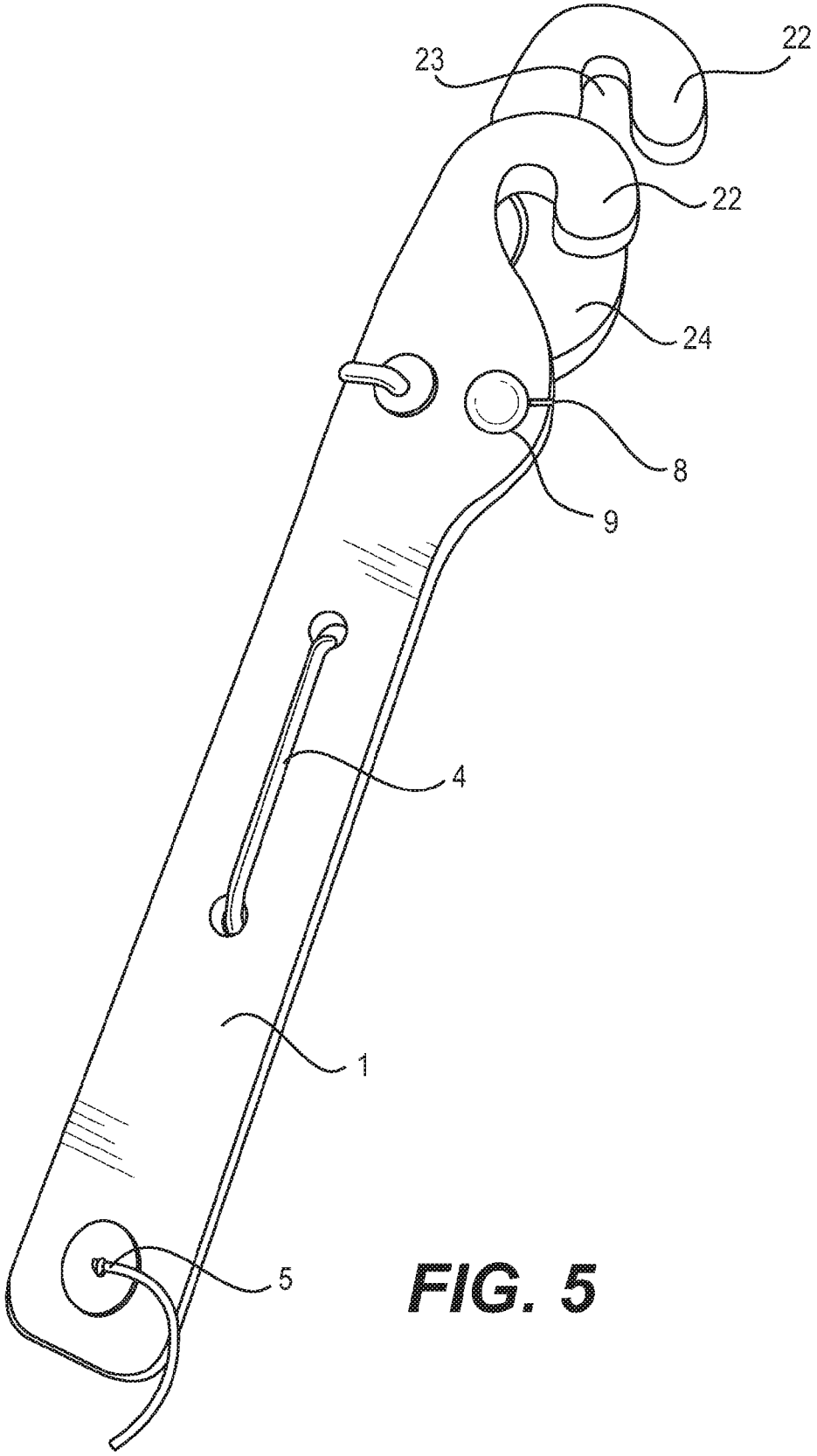
FIG. 5 is a side view of the ladder in the folded state.

FIGS. 4 and 5 show the ladder of the invention in its folded orientation. The ladder is folded by forcing the rails 1 slightly apart to allow the tapered rungs ends 6 to move out of tapered holes 7 and forcing one of the rails 1 downwardly with respect to the other rail. This allows the rails 1 to trap the rungs 3 in a position parallel to the rails 1 as the rails are moved closer to each other with the rungs lying therebetween as shown in FIGS. 4 and 5. Once positioned as in figured 4 and 5, the bungee cord enlargement 9 is manually pulled so cord end 4 is drawn into and held by slot 8 thereby holding the rails closed on the rungs maintaining the ladder in the folded position of FIGS. 4 and 5. In the folded orientation, the ladder can be stowed anywhere on the craft, preferably in the required safety equipment bag (in the case where the ladder is employed by a crew launch). The cord enlargement 9 can be of any construction capable of keeping the cord from passing through the slot 8 when the ladder is folded. A simple knot or the combination of a knot and apertured element could be used. A cane tip with a hole therethrough with a knotted bungee has proved effective.

Folding the ladder can be a bit awkward but it is important to note that folding is accomplished at a non-critical time. Assuming the ladder is used to rescue a swimmer, the ladder has been instantly erected for use when pulled from its stowed position (described below), hooked to the gunnel of the launch boat, used by the swimmer to get in the launch, and removed from the gunnel as the swimmer is taken to safely either on shore or on a bigger boat. The ladder can be re-folded any time prior to re-use of the launch or the safety equipment bag, in the case of crew use.

The folded ladder of FIGS. 4 and 5 can be instantly erected for use simply by pulling enlarged end 9 to removed cord end 4 from slot 8. When released, the tension of the bungee cord 4 draws the tapered rungs ends 6 into the tapered holes 7 of the rails forcing the ladder into the position of FIGS. 1 and 2. Since the force of a swimmer on the rungs is vertical with the ladder in a vertical orientation on the boat, the ladder maintains its FIGS. 1 and 2 orientation to allow the swimmer to climb into the boat to which it is attached.

Figure 6:
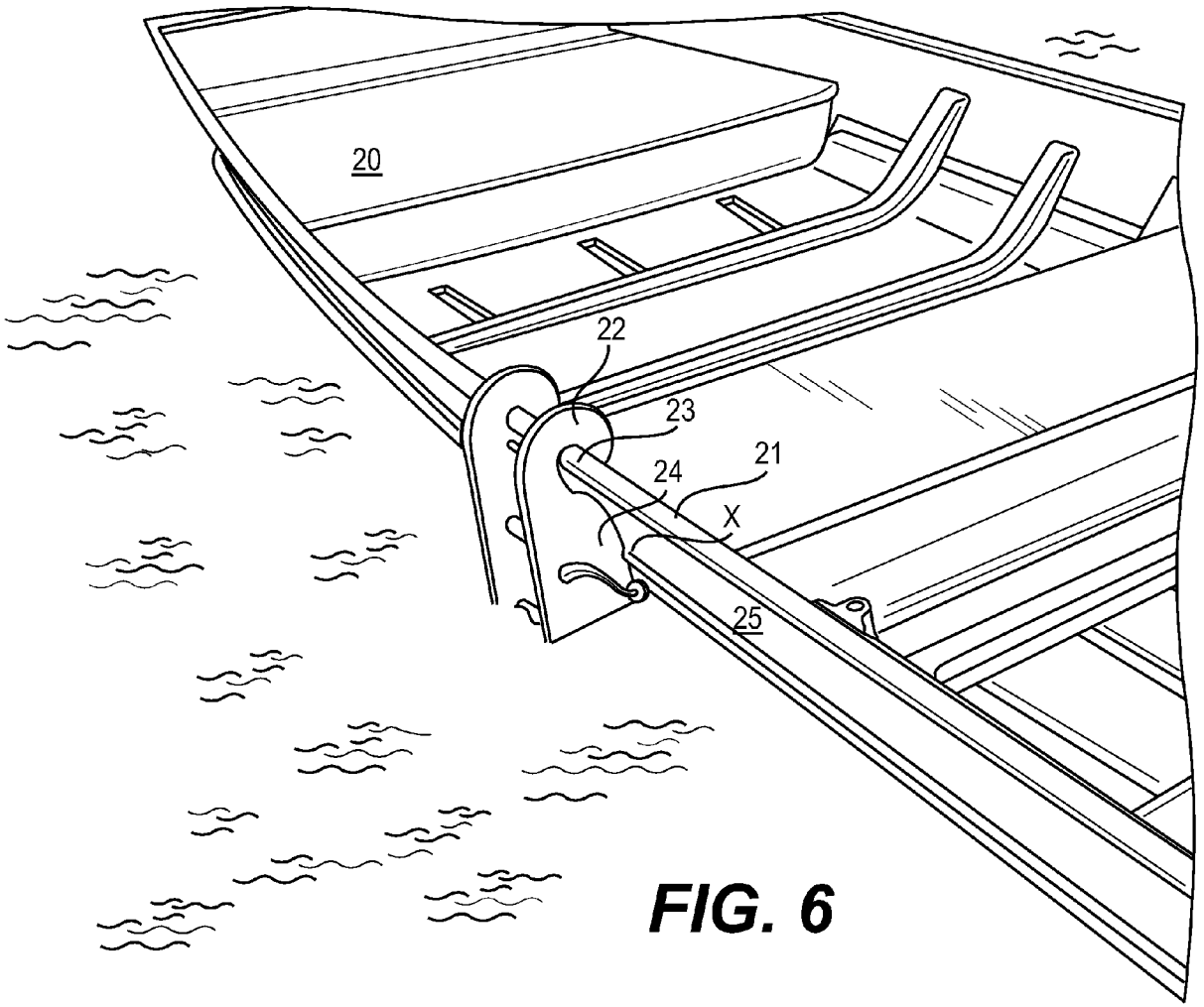
FIG. 6 shows the ladder mounted on the side of a jonboat.
Figure 7:
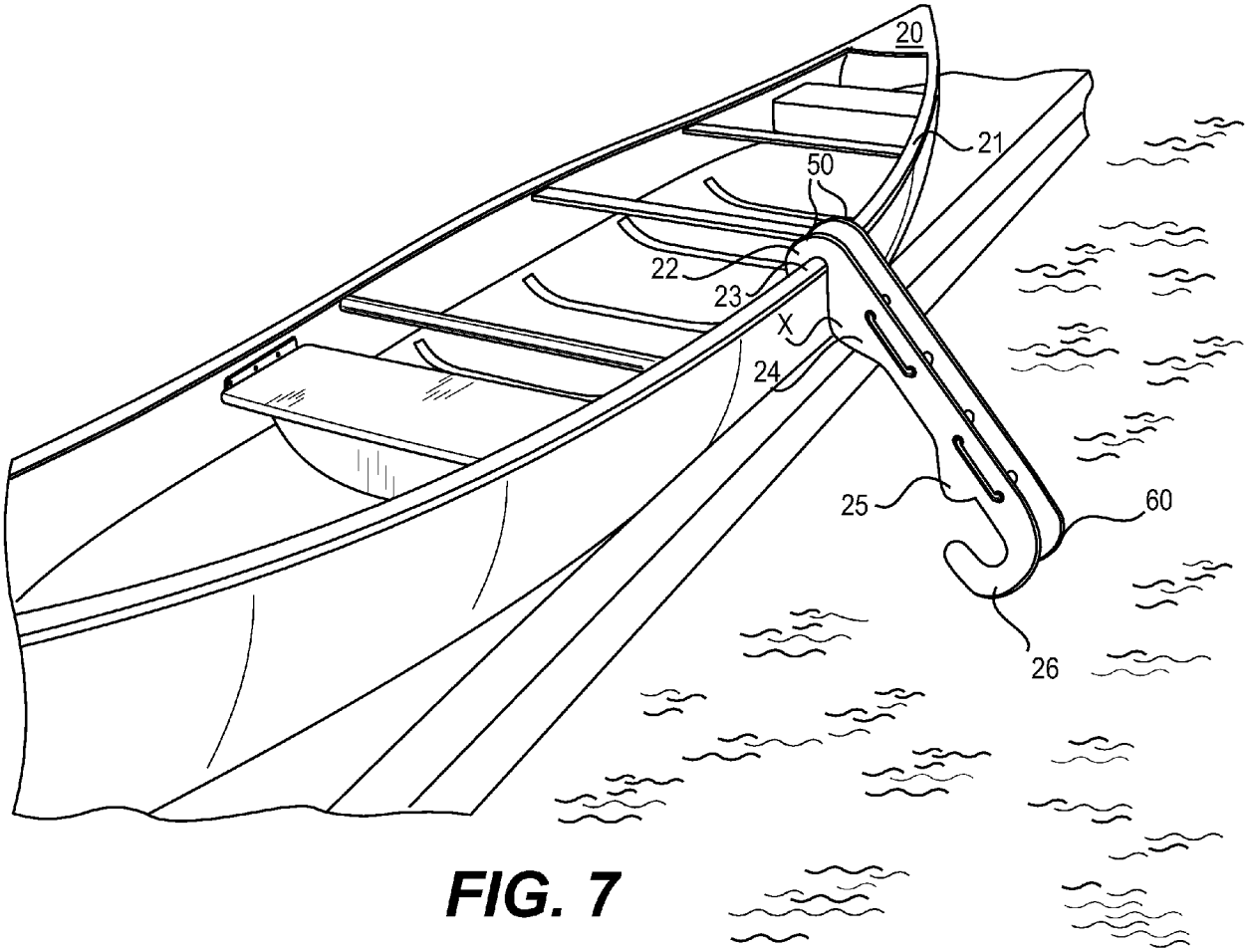
FIG. 7 shows the ladder mounted to the side of a canoe; the ladder having mounting means on each end, one end mounted to a canoe rail.
Figure 8:
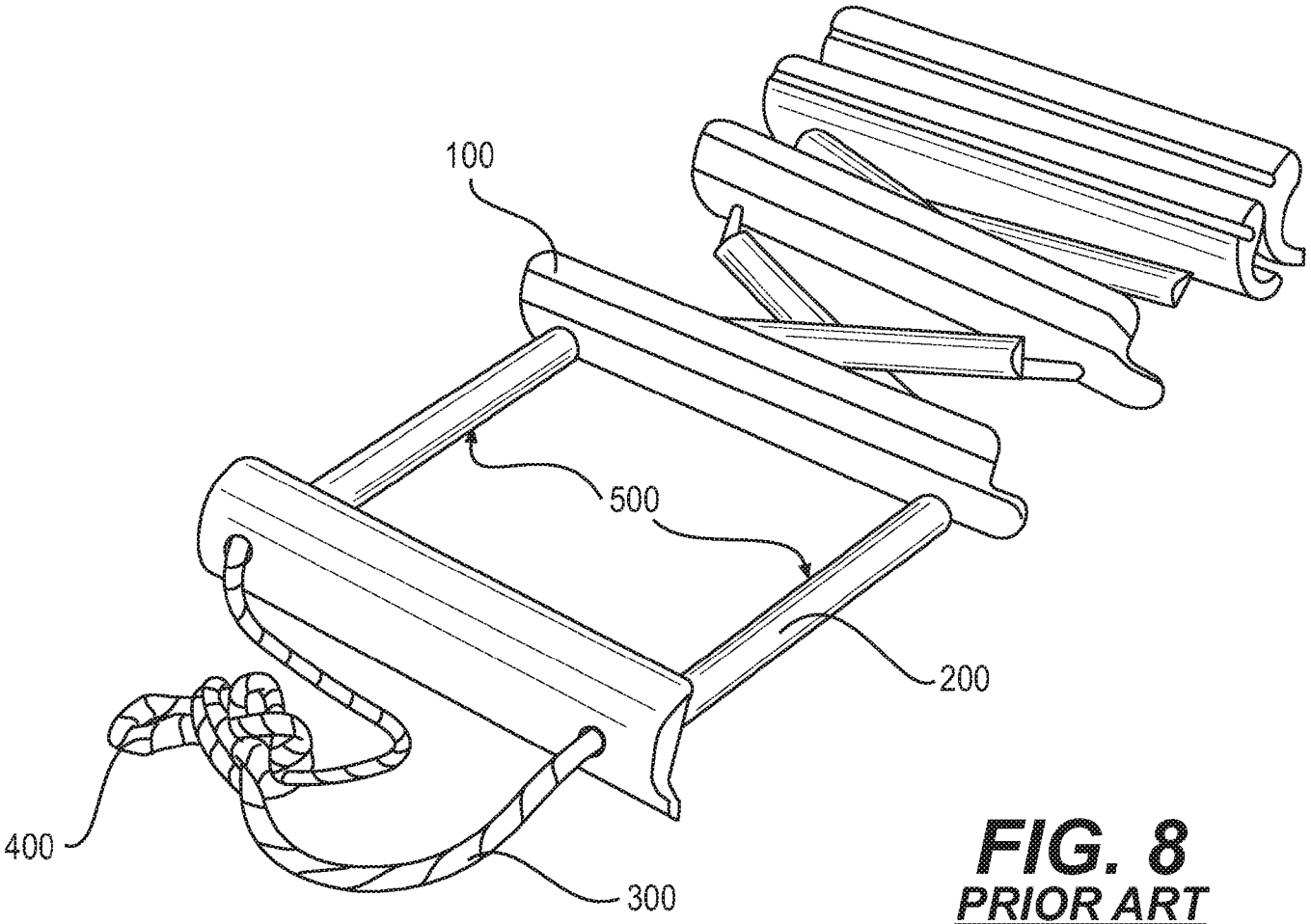
FIG. 8 PRIOR ART
FIG. 8 shows a conventional collapsing ladder.

A critical element of the invention is the means by which the ladder attached to the boat gunnels. FIG. 6 shows boat 20 (a jonboat boat, in this figure) having gunnels 21. The inventive ladder has hooks at the ends of rails 1. Hooks 22 have openings 23 sized to fit over gunnels 21. The hooks can be sized for any boat gunnel and are optimally sized to fit many common gunnels. The ladder ends also include a protrusion or bulge 24 to provide the stand-off feature of the ladder. Protrusion 24 lies against the boat hull sidewall 25 at point X to act with the hooks 22 to keep the ladder from moving with respect boat sidewall when under the load of a swimmer exiting the water. Since the protrusion 24 is at the top of the ladder, it will properly function on very shallow-draft hulls, unlike the previously mentioned stand-off legs at the bottom of many rigid ladders. The relationship between hooks 22, opening 23, and protrusion 24 orients the ladder at least vertically and optimally at an angle away from the boat (a canoe) as shown in FIG. 7. The important point here is that the swimmers can't force the ladder under the boat, preventing injury to feet and hands that would be trapped between the ladder and the boat sidewall and allowing easier exit from the water because of the positive angle of the ladder with respect to the boat. Of course, some boat hulls/gunnels are dimensioned such that the protrusions 24 are unnecessary for maintaining the ladder in the optimal position of at least vertical and, preferably, angled away from the boat hull as described elsewhere in this specification.

Hooks 22 can be provided on either end of the ladder as shown in FIG. 7 and be of different configuration on each end to allow a single ladder to be attached to various boat gunnels/sidewalls. The protrusion can be of any size or shape to mate with any sidewall. Hooks 26 on end 60 of the rails 1 can face in either direction (shown in FIG. 7 oriented in the same direction as hooks 22) to be attached to boat structure when the ladder is rotated 180 degrees such that hooks 26 are at the top of the ladder. Hooks 26 and/or protrusion/projection 25 are of different dimension than hooks 22 and/or projections 24. FIG. 7 clearly show the inventive ladder positioned at a positive angle from vertical making climbing much easier than if the ladder were allowed to move past vertical and under the boat hull.

Some boats will not accept the hooks described herein. It is anticipated that other attaching means can be used with the hooks. Knotted rope can mate with a variety of boat structures. The important aspect of this invention is that the ladder stand off from the boat sidewall to be near vertical and preferable angled away from the boat for easy use. Also, the ladder hooks can mount to any boat structure that will accept it such as existing fixed ladders, rear transoms, motor mounts or hand rails above gunnels. The ladder could be securely hung from a cleat, or a railing, or even the bracket for the outboard motor on some sailboats. Inasmuch as the ladder can be an emergency device, the means of hanging it on the boat within reach of the stranded swimmer in the water does not have to be particularly elegant, only quick and reasonably secure. It could be used even on boats that had gunwales too wide for the hooks and the user could attach a short (e.g. 3 foot) knotted rope to one of the hooks, with the free end of this rope looped inboard around a cleat, stanchion, winch, railing, or other nearby structure on the boat and then brought back to be inserted into the slot 8 in the other hook. If this short rope were already knotted at 6 inch intervals, the height of the ladder as it hung over the side of the hull could be easily and quickly adjusted simply by choosing which knot on the rope to insert in the slot 8 in the ladder. In fact, although it would be desirable for stability purposes that the hooks actually "grabbed" over the top of the gunwale. On sailboats and other boats like the Boston Whaler™ this might not always be possible because of their "smooth gunwale" design, the ladder would still be held securely in position by the looped rope in any event—and it would be far quicker to deploy and more stable to use than the non-rigid rope ladders that are presently on the market which need to be individually tied the boat's structure in some fashion before they are deployed overboard.

It is envisioned the ladder will float if dropped into the water. The rails 1 of the preferred embodiment are constructed from plastic or plywood and the rungs 3 of PVC. Materials are not critical to the invention provided they possess the required strength and desired characteristics (floatable, for one).

The dimension shown in the drawings are not meant to be limiting in any way. The invention is limited only by the claims.

I claim:

1. A folding ladder comprising:

first and second rails, each with inner and outer walls, a circumferential edge joining said walls, and having a top and bottom end, a plurality of hollow rungs of even or odd number with at least an upper rung and a lower rung, and elastic cord for holding said rungs in position between said rails, wherein;

each said first and second rails has a plurality of rail holes to accept one end of one of said plurality of rungs, wherein;

said elastic cord having first and second ends, said elastic cord passing through each said rung and said rails to tension said first and second rails toward each other to hold said rungs into engagement with said rail holes, further wherein, each said plurality of rail holes comprises at least two sizes, a first size extending less than fully through said rail from the inner rail wall and sized to accept one said rung, and a second size, smaller than said first size, extending from said rail outer wall and meeting said first size hole, said second size chosen to allow said elastic cord to pass therethrough but to stop said rung at an intermediate position in said rail.

2. The ladder of claim 1 wherein, each of said rungs is held in place by a length of said elastic cord, said cord having an enlargement at each first and second end to bear against said rail outer walls, said elastic cord tensioned to hold each rung in said rail hole by tensioning said rails toward each other.

3. The ladder of claim 2 wherein, said enlargement is a knot in the elastic cord.

4. The ladder of claim 1, wherein, said elastic cord comprises a continuous length of cord, said cord second end passing serially through a first hole in a first rail, a rung, a first hole in said second rail, upwardly or downwardly to a next said hole in said second rail and through said next hole, through another of said plurality of rungs, through said first rail, and through a next rail hole in said first rail, continuously until a last hole is reached, wherein said cord first and second ends are enlarged after passing through said rails and rungs so it cannot pass through said first hole in said first rail or a last rail hole in said first rail if the rungs are of even number or through a last rail hole in said second rail if the rungs are of an odd number.

5. A folding ladder for use on a boat comprising:

first and second rails with inner and outer walls, a circumferential edge joining said walls and having a top and bottom end, a plurality of hollow rungs of even or odd number with at least an upper rung and a lower rung, and elastic cord for holding said rungs in position between said rails, wherein;

each said first and second rails has a plurality of rail holes to accept one end of one of said plurality of rungs, wherein;

said elastic cord has first and second ends, said elastic cord passing through each said rung and said rails to tension said first and second rails toward each other to hold said rungs into engagement with said rail holes, further wherein, each said plurality of rail holes comprises at least two sizes, a first size extending less than fully through said rail from the inner rail wall and sized to accept one said rung, and a second size, smaller than said first size, extending from said rail outer wall and meeting said first size hole, said second size chosen to allow said elastic cord to pass therethrough but to stop said rung at an intermediate position in said rail, and, mounting hooks on each said rail for hanging said ladder to structure on a boat.

6. The ladder of claim 5 wherein, said mounting hooks comprise at least one hook associated with each said rail top end for hooking said rail to structure on a boat gunnell, said hook sized to provide a desired standoff distance from a boat side.

7. The ladder of claim 6 wherein, each said rail has a standoff projection adjacent said hook to bear against said boat to hold said ladder rails away from the boat to keep said ladder from moving toward the boat when climbed, each standoff of a predetermined size to provide a desired standoff distance from a boat side.

8. The ladder of claim 7 wherein, said standoff projection is integral with said rail.

9. The ladder of claim 7 wherein, said standoff projection is an attachment to said rail.

10. A method of folding a ladder, the ladder comprising:

first and second rails with inner and outer walls and a circumferential edge between said walls, a plurality of hollow rungs of even or odd number with at least an upper rung and a lower rung, and elastic cord for holding said rungs in position between said rails, wherein;

each said first and second rails has a plurality of rail holes to accept one end of one of said plurality of rungs, wherein;

said elastic cord for holding comprises first and second ends, said elastic cord passing through each said rung and said rails to tension said first and second rails toward each other to hold said rungs into engagement with said rail holes, further wherein, each said plurality of rail holes comprises at least two sizes, a first size extending less than fully through said rail from the inner rail wall and sized to accept one said rung, and a second size, smaller than said first size, extending from said rail outer wall and meeting said first size hole, said second size chosen to allow said elastic cord to pass therethrough but to stop said rung at an intermediate position in said rail, the method comprising, urging said rails away from each other by overcoming the elastic force of said cord thereby allowing said rungs to leave said holes, moving the first rail parallel with and closer to the second rail with one said hook above the other such that the rungs lie flat between the rails, and binding the assembly to make a compact arrangement.

11. The method of claim 10 wherein, each of said rungs is held in place by a length of said elastic cord, said cord having an enlargement at each first and second end to bear against said rail outer walls, said elastic cord tensioned to hold each rung in said rail hole by tensioning said rails toward each other, said cord having an extension from either the first or second end, said extension having a further enlargement at its end, the method further comprising; wrapping said extension around said rails when the ladder is in its folding state against the tension of the elastic cord and placing said further enlargement in a cord holder in either the first or second rail to secure the ladder it its folded state.

12. The method of claim 11 wherein, the cord holder is a slot in either said first or second rail.

13. The method of claim 11 further comprising a step of erecting said ladder from said compact arrangement for use, the method comprising:

releasing said further enlargement from said cord holder, said releasing causing the tension of the elastic cord to pull the rails parallel to and away from each other while said rungs become parallel to allow said rungs to enter said rail holes to orient the ladder for use.

14. The ladder of claim 5 wherein;

said mounting hooks are positioned on both said top end and bottom end of each said rail, the top end mounting hooks having different dimensions from the bottom end mounting hooks to allow the ladder to be hung on differently dimensioned boats or differently dimensioned areas of the same boat.

15. The ladder of claim 6 wherein;

said hooks for mounting comprise hooks on both said top end and said bottom end of each said rail, the top end hooks having different dimensions from the bottom end hooks to allow the ladder to be used on differently dimensioned boats or differently dimensioned areas of the same boat.

16. The ladder of claim 7 wherein;

each said rail top end and bottom end has a standoff projection part adjacent said hook bearing against said boat to hold said ladder rails away from the boat to keep said ladder from moving toward the boat when used, each standoff sized to provide a desired standoff distance from a boat side, the top end hook and/or standoff having dimensions different from the hook/standoff of the bottom end to allow the ladder to be used on plural boats.

17. A ladder for use on a boat comprising:

first and second rails with inner and outer walls, a circumferential edge between said walls and having a top and bottom end, mounting hooks on said rail top end for mounting said ladder to structure on a boat, a plurality of hollow rungs of even or odd number with at least an upper rung and a lower rung, each said first and second rails having a plurality of rail holes to accept one end of one of said plurality of rungs, elastic cord for holding said rungs in position between said rails, said elastic cord passing through each said rung and said rails to tension said first and second rails toward each other to hold said rungs into engagement with said rail holes;

wherein said mounting hooks comprise at least one hook associated with each said rail top end for hooking said rail to structure on a boat, said hook of a predetermined size to mate with a boat gunnell, and, on each said rail, a standoff projection adjacent said hook extending from said rail to bear against said boat to hold said ladder rails away from the boat and acting to keep said ladder from moving toward the boat when climbed, each standoff sized to provide a desired standoff distance from a boat side.

18. The ladder of claim 17 wherein, said standoff projection is integral with said rail.

19. The ladder of claim 17 wherein, said standoff projection is an attachment to said rail.

* * * * *